United States Patent [19]

Gregory, III

[11] Patent Number: 4,763,672

[45] Date of Patent: Aug. 16, 1988

[54] APPARATUS FOR INJECTING LIQUID-TYPE MATERIAL IN THE CHIMNEY OF A CIGARETTE MAKER

[75] Inventor: Joseph L. Gregory, III, Richmond, Va.

[73] Assignee: Philip Morris Incorporated, New York, N.Y.

[21] Appl. No.: 942,411

[22] Filed: Dec. 16, 1986

[51] Int. Cl.[4] ..... A24B 15/28; A24C 15/18; A24D 1/00; A24D 1/18

[52] U.S. Cl. ..... 131/79; 131/84.1; 131/84.3

[58] Field of Search ..... 131/79, 84.1, 84.3

[56] References Cited

U.S. PATENT DOCUMENTS 3,851,652 12/1974 Labbe ..... 131/84.3
4,619,276 10/1986 Albertson et al. ..... 131/79

*Primary Examiner*—V. Millin
*Attorney, Agent, or Firm*—Jeffrey H. Ingerman

[57] ABSTRACT

Apparatus is provided for injecting liquids or liquid foams into the stream of tobacco on the suction tape in the chimney of a cigarette maker. An insert is placed in the suction rod channel to reduce its width over an initial section of the channel. The remainder of the channel is of normal width. A nozzle for injecting the liquid or liquid foam projects gradually from the end of the insert into the channel. The restrictive effect of the nozzle on the flow of tobacco is balanced by the tendency of the tobacco to flow more freely as the channel widens.

29 Claims, 3 Drawing Sheets

FIG. 4
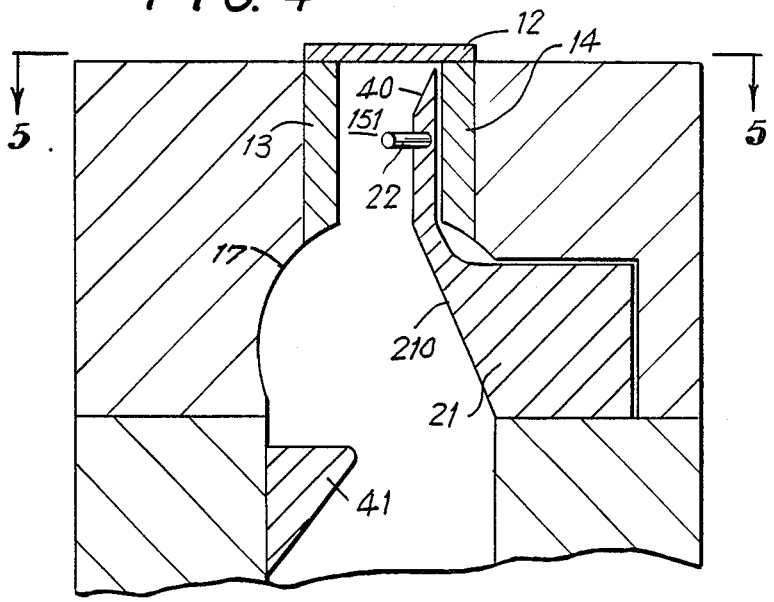
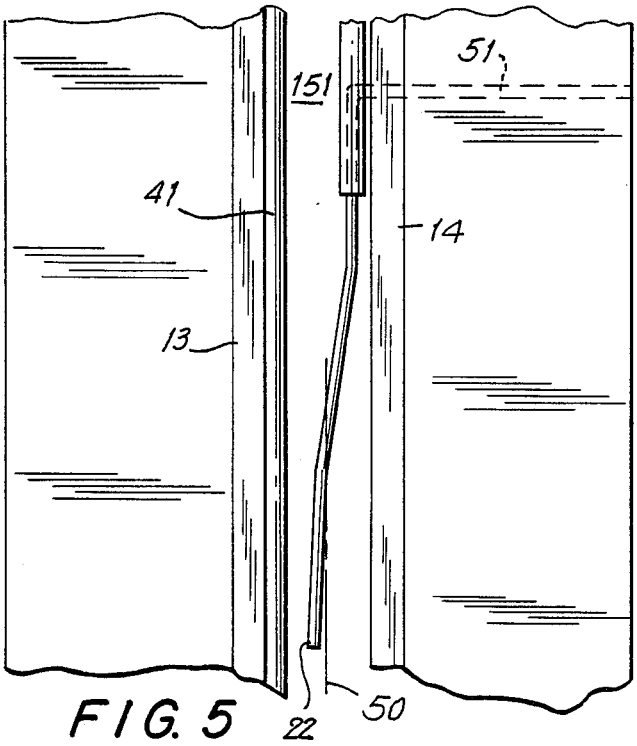
FIG. 5

APPARATUS FOR INJECTING LIQUID-TYPE MATERIAL IN THE CHIMNEY OF A CIGARETTE MAKER

BACKGROUND OF THE INVENTION

This invention relates to apparatus for injecting liquid-type material into the tobacco stream in the chimney of a cigarette maker. In particular, this invention relates to apparatus for injecting liquid additive foam into the tobacco accumulating on the suction tape in the chimney of a cigarette maker.

As is well known in the cigarette making art, most cigarette makers include a chimney section in which tobacco is sucked upward onto the underside of a perforated tape. The tobacco accumulates on the underside of the tape in a narrow channel between two rails on which the tape rides. The tape moves horizontally, carrying a stream of tobacco out of the chimney to subsequent sections of the cigarette maker. If one considers any particular length of the tape, the thickness of the layer of tobacco on that length of tape increases as the tape moves across the chimney, because the time the length of tape has been exposed to the tobacco flow increases. Therefore, the layer of tobacco on the tape is thickest at the point where the tape leaves the chimney.

It is also well known that material can be added to the tobacco stream in a cigarette maker, e.g., for purposes of binding or flavoring the cigarettes produced. Commonly-assigned U.S. Pat. No. 4,619,276 discloses that such material can be added in the form of a liquid foam at various points in a cigarette maker, including in the chimney, and particularly at the suction tape, after the tobacco has accumulated into a sufficient mass to accept the added material. It is disclosed in said commonly-assigned patent that a nozzle can be positioned just below and parallel to the suction tape for dispensing the liquid foam.

It has been found, however, that if such a nozzle is inserted into the suction tape channel of a standard cigarette maker chimney, the nozzle would interfere with the horizontal transport of tobacco by the suction tape and result in choking of the cigarette maker as tobacco built up behind the nozzle.

It would therefore be desirable to provide apparatus for injecting liquid-type material, including foamed liquid material or other liquid material, into the tobacco stream in the chimney of a cigarette maker without causing the maker to choke.

SUMMARY OF THE INVENTION

It is an object of this invention to provide apparatus for injecting liquid-type material into the tobacco stream in the chimney of a cigarette maker without causing the maker to choke.

In accordance with this invention, there is provided apparatus for injecting liquid-type material into cigarette filler in the chimney section of a cigarette making machine. The chimney is open at the bottom thereof to a supply of cigarette filler and has at the top thereof a perforated suction tape. Suction is applied from above the suction tape, which rides horizontally in one direction on a pair of spaced-apart wear-resistant rails from a first side of the chimney to a second side thereof. The spacedapart rails form a channel therebetween. Filler accumulates in the channel by virtue of the suction and is carried horizontally by the suction tape to subsequent sections of the cigarette making machine for formation into a cigarette rod. The channel comprises a first portion beginning at the first side of the chimney and extending to a first point between the first and second sides, and a second portion extending from the first point to the second side. The first portion is narrower than the second portion. The apparatus also comprises means for injecting liquid-type material into the accumulated filler in the second portion adjacent the first point.

A chimney for a cigarette making machine, said chimney including such apparatus, is also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 4 is a widthwise cross-sectional view of the wide portion of the top section of the chimney of a cigarette making machine according to the invention looking toward the narrow portion, taken from line 4—4 of FIG. 3; and FIG. 5 is a plan view of the top section of the chimney of a cigarette making machine according to the present invention.

DETAILED DESCRIPTION OF THE INVENTION

Figure 1:
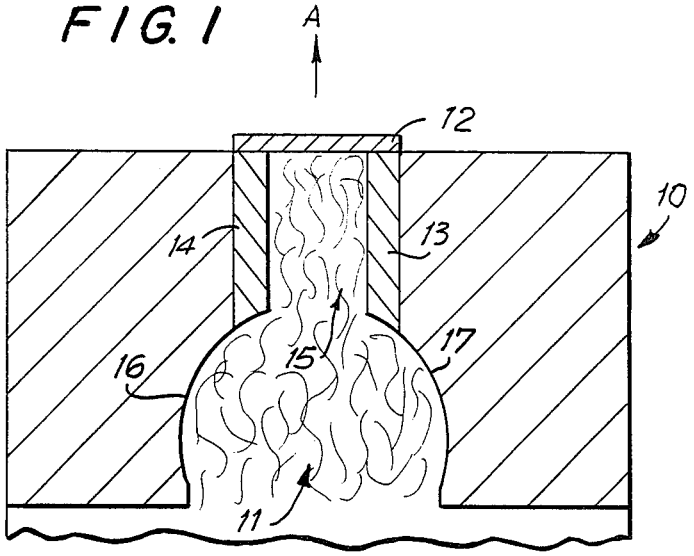
FIG. 1 is a widthwise cross-sectional view of the top section of the chimney of a conventional cigarette making machine.
Figure 2:
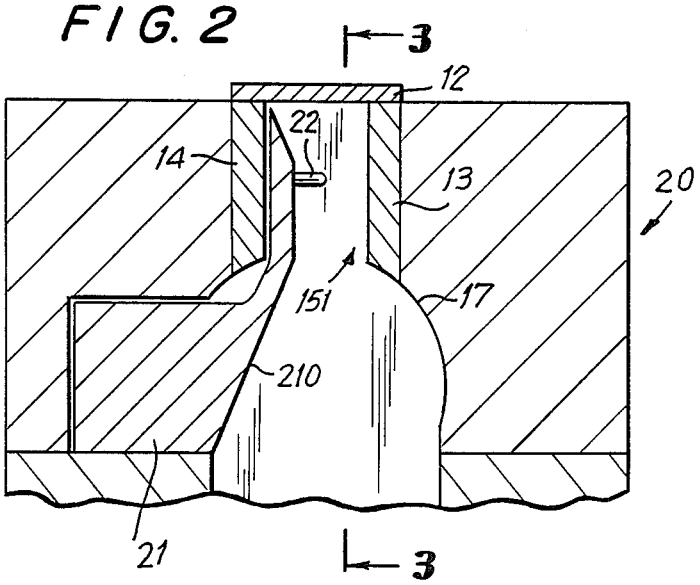
FIG. 2 is a widthwise cross-sectional view of the narrow portion of the top section of the chimney of a cigarette making machine according to this invention.

FIG. 1 is a widthwise cross-sectional view of the top section 10 of the chimney of a conventional cigarette making machine. Shredded tobacco filler 11 is introduced at the bottom of the chimney (not shown) and blown upward toward perforated suction tape 12, generally made of stainless steel, assisted by suction (indicated by arrow A) applied from above tape 12. Tape 12 rides on wear-resistant rails 13, 14 made of a material such as tungsten carbide which is harder than stainless steel. Filler 11, guided by walls 16, 17, accumulates in the channel 15 formed by rails 13, 14 and is carried out of the chimney to subsequent sections of the cigarette making machine by tape 12 which moves horizontally—i.e., into or out of the plane of FIG. 1.

In order to introduce liquid-type material, such as liquid additive foam, into the accumulated filler 11 in the manner suggested by said above-identified U.S. Pat. No. 4,619,276, it would be necessary to insert a nozzle (not shown) into channel 15. However, channel 15 would then be restricted at the point at which the nozzle is inserted and tobacco filler that had moved freely through channel 15 at a given volume rate up to that point would no longer be able to move at that volume rate. As a result, tobacco filler would pile up at the point of nozzle insertion, conceivably to the extent of choking off the flow of filler completely. As a consequence, only filler first reaching tape 12 downstream of the nozzle would be carried to subsequent sections of the cigarette making machine, which would not provide sufficient filler volume for cigarette production. There also would not be a sufficient volume of tobacco at the downstream end of the nozzle to receive the liquid-type material, resulting in poor distribution of the liquid-type material in that tobacco filler that did reach subsequent sections of the cigarette making machine.

The present invention overcomes these difficulties by providing a channel having a narrower than normal width over an initial portion of its length. The nozzle is introduced into the channel after the transition to normal width. The choking effect of the nozzle is counterbalanced by the easing of flow restrictions caused by the widening of the channel. The placement and shape of the nozzle are also designed to minimize flow disruptions.

Figure 3:
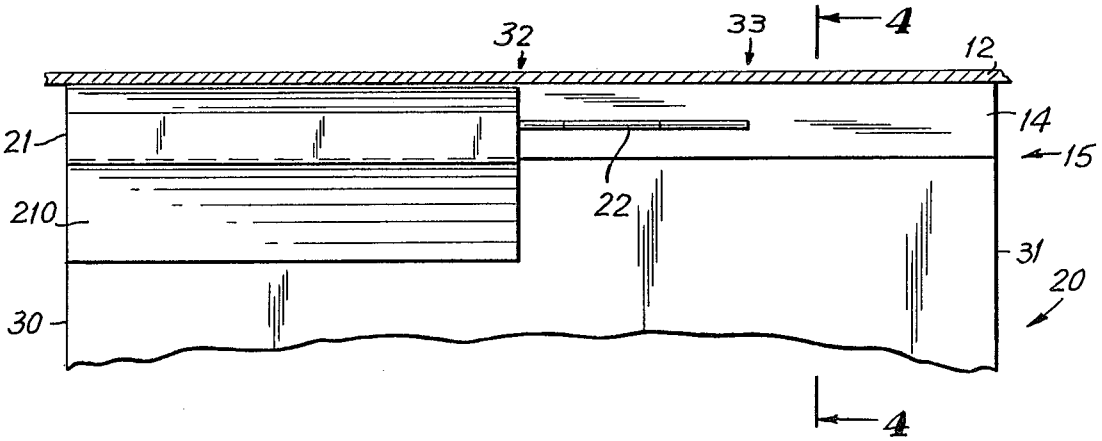
FIG. 3 is a lengthwise cross-sectional view of the top section of the chimney of a cigarette making machine according to this invention, taken from line 3—3 of FIG. 2.

The top section 20 of a modified chimney according to the invention is shown in FIGS. 2–5. As best seen in FIG. 3, chimney 20 extends from a first side 30 to a second side 31. An insert 21 extending between first side 30 and a point 32 narrows channel 15 between first side 30 and point 32 to form narrow portion 151 of channel 15. Angled surface 210 of insert 21 guides filler 11 into narrowed channel portion 151. Nozzle 22 extends into the standard width portion of channel 15 at point 33, adjacent point 32. In the absence of nozzle 22, tobacco passing from narrow portion 151 of channel 15 to the standard width portion of channel 15 would flow more freely. The tendency to flow more freely compensates for any flow restricting effect that might be caused by the presence of nozzle 22. Nozzle 22 is connected by pipe 51 to a supply (not shown) of liquid-type material.

The placement and design of nozzle 22 further reduce the possibility of choking. Nozzle 22 is preferaby a very thin hypodermic-type tube. Nozzle 22 preferably projects from the end face 40 of insert 21 and extends for a short distance parallel to the direction of tobacco flow before gradually angling out into the flow and straightening to a direction generally parallel to the flow at about the centerline 50 of channel 15. The gradual migration of nozzle 22 across the tobacco flow reduces the restrictive effect of the nozzle on the flow. Nozzle 22 preferably should cross slightly beyond centerline 50 and straighten out to a direction angled slightly away from centerline 50 and toward rail 13. This compensates for the slight deflection of nozzle 22 caused by the pressure of the tobacco flow against the migrating portion of nozzle 22, so that the actual operating position of the exit of nozzle 22 is at centerline 50 and parallel to the tobacco flow. Nozzle 22 should at least be near centerline 50, so that a buffer layer of dry tobacco filler is maintained between tobacco wetted by the liquid-type material and rails 13, 14, to prevent fouling of the machine.

Preferably, a wedge-shaped deflector 41 is placed along one wall of the chimney under rail 13. This deflector 41 aids in channelling tobacco filler into the void between nozzle 22 and rail 14.

It has been found that even when no liquid-type material is introduced through nozzle 22, cigarettes produced in cigarette making machines incorporating this invention have improved firmness over cigarettes made in machines not incorporating the invention. It is believed that nozzle 22 may act as a mandrel, forcing the tobacco filler to assume a radial orientation as it wraps around nozzle 22, thereby increasing firmness in the finished cigarette.

Thus, it is seen that apparatus is provided for injecting liquid-type material in the chimney section of a cigarette making machine without choking or fouling of the machine. One skilled in the art will appreciate that the present invention can be practiced by other than the embodiments described, which are presented for purposes of illustration and not of limitation, and the present invention is limited only by the claims which follow.

What is claimed is:

1. Apparatus for injecting liquid-type material into cigarette filler in the chimney of a cigarette making machine, said chimney being open at the bottom thereof to a supply of cigarette filler and having at the top thereof a perforated suction tape, suction being applied from above said suction tape, said suction tape riding horizontally in one direction on a pair of spaced-apart wear-resistant rails from a first side of said chimney to a second side thereof, said spaced-apart rails forming a channel therebetween, whereby said filler accumulates in said channel by virtue of said suction and is carried horizontally by said suction tape to subsequent sections of said cigarette making machine for formation into a cigarette rod, wherein:

said channel comprises a first portion beginning at said first side of said chimney and extending to a first point between said first and second sides and a second portion extending from said first point to said second side and having a centerline, said first portion being narrower than said second portion; said apparatus further comprising:

means for injecting said liquid-type material into said accumulated filler in said second portion of said channel at a second point adjacent said first point.

2. Apparatus according to claim 1 wherein:

said rails are uniformly spaced apart along the entire length of said channel, said narrower first portion being formed by at least one and at most two inserts in said channel, each of said at least one and at most two inserts abutting one of said rails, and extending longitudinally therealong, each of said inserts having a first end face at said first side and a second end face at said first point; and said injecting means comprises nozzle means having a length and extending into said channel at said second point.

3. Apparatus according to claim 2 wherein said nozzle means extends into said channel from said second end face of one of said at least one inserts.

4. Apparatus according to claim 3 wherein said nozzle means extends longitudinally from said second end face along at least a first part of its length.

5. Apparatus according to claim 4 wherein said nozzle means extends along a second part of its length, beginning at the end of said first part of its length, at an oblique angle from said longitudinally extending first part of its length.

6. Apparatus according to claim 5 wherein said nozzle means extends along a third part of its length, beginning at the end of said second part of its length, longitudinally along said channel.

7. Apparatus according to claim 6 wherein said third part of said nozzle means extends along that centerline of said second portion of said channel.

8. Apparatus according to claim 6 wherein said third part of said nozzle extends along a line which is spaced further from said first part than is said centerline.

9. Apparatus according to claim 8 wherein said narrower first portion is formed by one insert.

10. Apparatus according to claim 8 further comprising means for guiding said filler into a space between said nozzle means and that one of said rails along which extends said at least one insert.

11. Apparatus according to claim 10 wherein said guiding means comprises an insert extending along a portion of a wall of said chimney beneath said nozzle, said means having a tapered surface such that tobacco rising in the region of said insert is guided into said space.

12. Apparatus according to claim 2 wherein said narrower first portion is formed by one insert.

13. Apparatus according to claim 2 further comprising means for guiding said filler into said channel.

14. Apparatus according to claim 13 wherein said guiding means comprises a tapered surface extending downwardly from said at least one inserts toward a wall of said chimney.

15. A chimney for a cigarette making machine, said chimney being open at the bottom thereof to a supply of cigarette filler and having at the top thereof a perforated suction tape, suction being applied from above said suction tape, said suction tape riding horizontally in one direction on a pair of spaced-apart wear-resistant rails from a first side of said chimney to a second side thereof, said spaced-apart rails forming a channel therebetween, whereby said filler accumulates in said channel by virtue of said suction and is carried horizontally by said suction tape to subsequent sections of said cigarette making machine for formation into a cigarette rod, wherein:

said channel comprises a first portion beginning at said first side of said chimney and extending to a first point between said first and second sides and a second portion extending from said first point to said second side and having a centerline, said first portion being narrower than said second portion; said chimney further comprising:

means for injecting liquid-type material into said accumulated filler in said second portion of said channel at a second point adjacent said first point.

16. A chimney according to claim 15 wherein:

said rails are uniformly spaced apart along the entire length of said channel, said narrower first portion being formed by at least one and at most two inserts in said channel, each of said at least one and at most two inserts abutting one of said rails, and extending longitudinally therealong, each of said inserts having a first end face at said first side and a second end face at said first point; and said injecting means comprises nozzle means having a length and extending into said channel at said second point.

17. A chimney according to claim 16 wherein said nozzle means extends into said channel from said second end face of one of said at least one inserts.

18. A chimney according to claim 17 wherein said nozzle means extends longitudinally from said second end face along at least a first part of its length.

19. A chimney according to claim 18 wherein said nozzle means extends along a second part of its length, beginning at the end of said first part of its length, at an oblique angle from said longitudinally extending first part of its length.

20. A chimney according to claim 19 wherein said nozzle means extends along a third part of its length, beginning at the end of said second part of its length, longitudinally along said channel.

21. A chimney according to claim 20 wherein said third part of said nozzle means extends along the centerline of said second portion of said channel.

22. A chimney according to claim 20 wherein said third part of said nozzle means extends along a line which is spaced further from said first part than is said centerline.

23. A chimney according to claim 22 wherein said narrower first portion is formed by one insert.

24. A chimney according to claim 22 further comprising means for guiding said filler into a space between said nozzle and that one of said rails along which extends said at least one insert.

25. A chimney according to claim 24 wherein said guiding means comprises an insert extending along a portion of a wall of said chimney beneath said nozzle, said means having a tapered surface such that tobacco rising in the region of said insert is guided into said space.

26. A chimney according to claim 16 wherein said narrower first portion is formed by one insert.

27. A chimney according to claim 16 further comprising means for guiding said filler into said channel.

28. A chimney according to claim 27 wherein said guiding means comprises a tapered surface extending downwardly from said at least one insert toward a wall of said chimney.

29. A cigarette making machine for producing cigarettes having improved firmness, said machine including a chimney open at the bottom thereof to a supply of cigarette filler and having at the top thereof a perforated suction tape, suction being applied from above said suction tape, said suction tape riding horizontally in one direction on a pair of spaced-apart wear-resistant rails from a first side of said chimney to a second side thereof, said spaced-apart rails forming a channel therebetween, whereby said filler accumulates in said channel by virtue of said suction and is carried horizontally by said suction tape to the remainder of said cigarette making machine for formation into a cigarette rod, wherein:

said channel comprises a first portion beginning at said first side of said chimney and extending to a first point between said first and second sides and a second portion extending from said first point to said second side and having a centerline, said first portion being narrower than said second portion; said machine further comprising:

mandrel means in said second portion of said channel at a second point adjacent said first point, said filler flowing around said mandrel means.

* * * * *